United States Patent [19]

Wirz

[11] 3,938,800

[45] Feb. 17, 1976

[54] SUCTION HEAD FOR SHEET FEEDING APPARATUS

[75] Inventor: Arno Wirz, Bammental, Germany

[73] Assignee: Heidelberger Druckmaschinen Aktiengesellschaft, Heidelberg, Germany

[22] Filed: Oct. 3, 1974

[21] Appl. No.: 511,688

Related U.S. Application Data

[63] Continuation of Ser. No. 352,191, April 18, 1973, abandoned.

[30] Foreign Application Priority Data

Apr. 26, 1972 Germany ..... 2220353

[52] U.S. Cl. ..... 271/93; 271/98

[51] Int. Cl.[2] ..... B65H 3/08

[58] Field of Search ..... 271/91, 92, 93, 97, 98, 271/106, 107, 108, 30, 31, 11, 14, 103

[56] References Cited

UNITED STATES PATENTS

| | | | |
|---|---|---|---|
| 1,427,002 | 8/1922 | Lorig et al. | 271/30 R |
| 2,221,981 | 11/1940 | Martin | 271/103 X |
| 2,722,416 | 11/1955 | Backhouse | 271/108 X |
| 3,471,141 | 10/1969 | Ruetschle | 271/93 |

*Primary Examiner*—Evon C. Blunk
*Assistant Examiner*—Bruce H. Stoner, Jr.
*Attorney, Agent, or Firm*—Herbert L. Lerner

[57] ABSTRACT

A suction head for feeding sheets in sheet-processing machines from a stacked pile of sheets to further sheet transporting means includes suction separation devices for lifting sheets off of a pile of sheets and transport suction devices for taking over the lifted sheet lifted by the suction separation devices and advancing the lifted sheet in a transport direction towards the further sheet transporting means. Control means are provided for moving the separation suction devices in the transport direction for at least part of the transport distance at the same velocity as the transport suction devices whereby the suction separation devices assist in transporting the lifted sheet over the aforementioned part of the transport distance.

10 Claims, 4 Drawing Figures

Fig.1
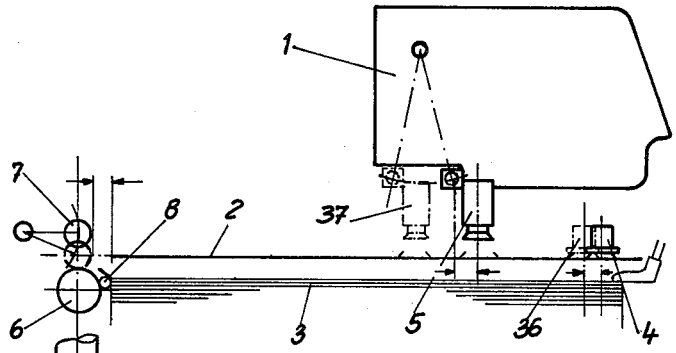
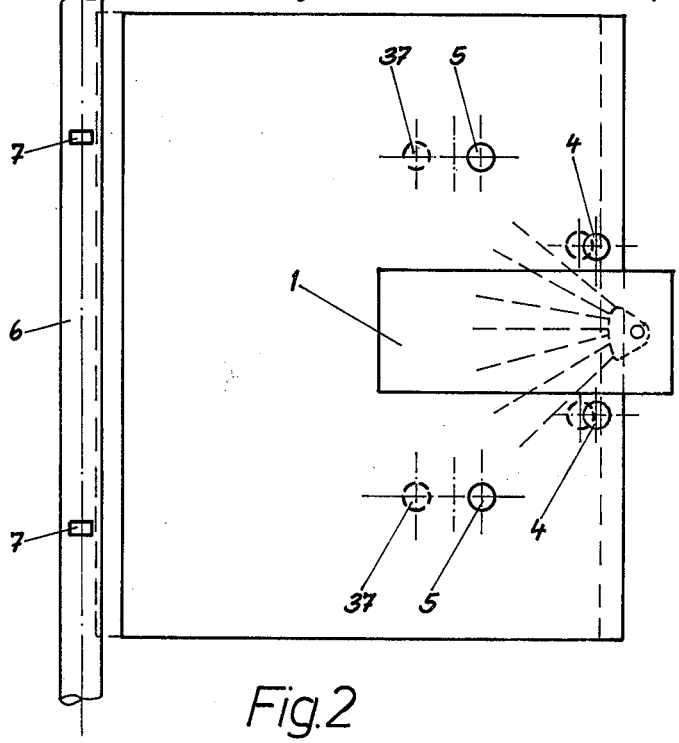
Fig.2

SUCTION HEAD FOR SHEET FEEDING APPARATUS

This is a continuation of application Ser. No. 352,191, filed Apr. 18, 1943, now abandoned.

This invention relates to a suction head for sheet feeding apparatus as used in conjunction with sheet-processing machines for forming overlapping sheet feeding, with separation suction devices for lifting sheets off a pile, as well as with transport suction devices which take over the sheet lifted by the separation suction devices and advance it in a direction toward further sheet transporting means.

An object of the present invention is to make the feeding of sheets more reliable, particularly in machines handling large sheet sizes.

In suction heads of the kind mentioned hereinabove, separation suction devices initially lift the top sheet off of a pile. Then a probing foot which is hinged at the suction head is reset on what has then become the new top sheet of the pile. Nozzles are provided in the probing foot and these nozzles blow air against the underside of the lifted sheet. The blast of air provides a support cushion which carries the sheet in such a manner that its front edge is lifted above the stops. The supporting air is blown out in synchronism with the printing machine operation. The air blast must be terminated when the separation suction devices have passed the sheet on to the transport suction devices.

As soon as the separation suction devices release the lifted sheet, its rear part drops onto the pile. If air would still continue to flow from the nozzles of the probing foot, this air flow would strike the top side of the sheet being transported by the transport suction devices. Thus the sheet would be blown together in the direction toward the transport cylinder and thereby cause an interruption in the operation.

While the transport suction devices grip the sheet in its rear third portion, the front part of the transported sheet drops down on the pile as soon as the stream of blast air terminates and the air cushion is exhausted. If the air cushion disappears too fast, the front edge of the sheet might hang up at the controlled stops and not be pushed into the gap between the transport cylinder and the timing rollers. This phenomenon is called "stumbling" of the sheet and leads to operational disturbances.

The principal disadvantage of the premature termination of the blast of supporting air is, however, that when the forward part of the transported sheet drops down, the front edge of the sheet moves away somewhat from the transport cylinder. This phenomenon is called "falling back" of the sheet. The distance by which the dropping front edge of the sheet falls back in this process must be compensated by the transport suction devices by increasing the transport travel. If the sheet were supported by the blast air continuously during the transport, the travel distance would therefore be shorter. The actual travel distance of the transport suction devices is consequently longer by the lost distance which is caused by the dropping of the forward portion of the transported sheet due to early termination of the blast of support air.

However, the longer the transport distance, the greater also is the load on the control and drive parts of the suction head. An increase in output and the service life are therefore substantially dependent on the transport distance required. Furthermore, a high transport velocity resulting from a relatively long transport distance has an unfavorable effect on the running of the sheet.

From German Pat. No. 1,943,913 it is known to provide a suction head in which, at the mountings for the shaft of the transport suction devices, a third transport suction device is attached. In the sheet transfer position, the third transport suction device is aligned with the lift suction devices and therefore, permits a prolonged blasting of the support air by holding the sheet at the rear edge during the transport toward the further sheet transporting means.

This known suction head, however, has several shortcomings. For one, the third suction device which is attached to the sliding carriage of the transport suction devices must be adjusted to the transfer height of the lift suction devices. As a consequence, the third suction device slides during its return on the sheet, which has already been lifted up by the transport suction devices, and causes undesirable marks. Furthermore, in the case of thin paper, a lateral drooping of the sheet is not impossible. The drooping rear corners of the sheet can be influenced detrimentally by the support air which leads to the abovementioned disturbances.

It is a further disadvantage that the additional third transport suction device increases the weight of the reciprocating mass and therefore interferes with an increase in output. Finally, the sucking up of the lifted sheet by three transport suction devices is critical insofar as these suction devices are situated in different planes. A malfunction of one of these suction devices causes the deactivation of the others, that is, the sheet is not transferred properly.

Accordingly, it is an object of the present invention to provide low-cost suction heads of the type mentioned above which are arranged such that during the sheet transport, blast air can flow under the transported sheet as long as possible without the danger of blowing against drooping parts of the sheet and without increasing the weight of the reciprocating masses of the transport suction devices.

The disadvantages of the aforementioned prior art devices are overcome in the present invention by providing control means that move the separation suction devices in the transport direction, after lifting the sheet, for part of the travel distance of the transport suction devices with the same velocity as the latter, whereby the separation suction devices assist in carrying the lifted sheet during this part of the transported distance.

A particularly advantageous embodiment of the invention consists in providing that the separation suction devices are driven periodically by a lever mechanism moved by a cam having an external curve; that vertical parallel guidance device is provided; that the parallel guidance device is suspended in pendulum fashion; and that a control cam swings the parallel guidance device and therewith the separation suction devices synchronously with the transport suction devices in the transport direction.

The resulting improvement of the sheet transfer to the transport means which transport the sheet further, as well as the now possible increase in output were obtained in suction heads with parallel-guided separation suction devices by few additional means. Only the swinging suspension of the parallel guidance device as well as the arrangement of an additional cam on the control shaft were necessary for this purpose.

Other features which are considered as characteristic for the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is an elevational view of a section head, according to one embodiment of the invention, disposed above a pile of sheets to be fed.

FIG. 2 is a top view of the suction head and the pile of sheets shown in FIG. 1.

Figure 3:
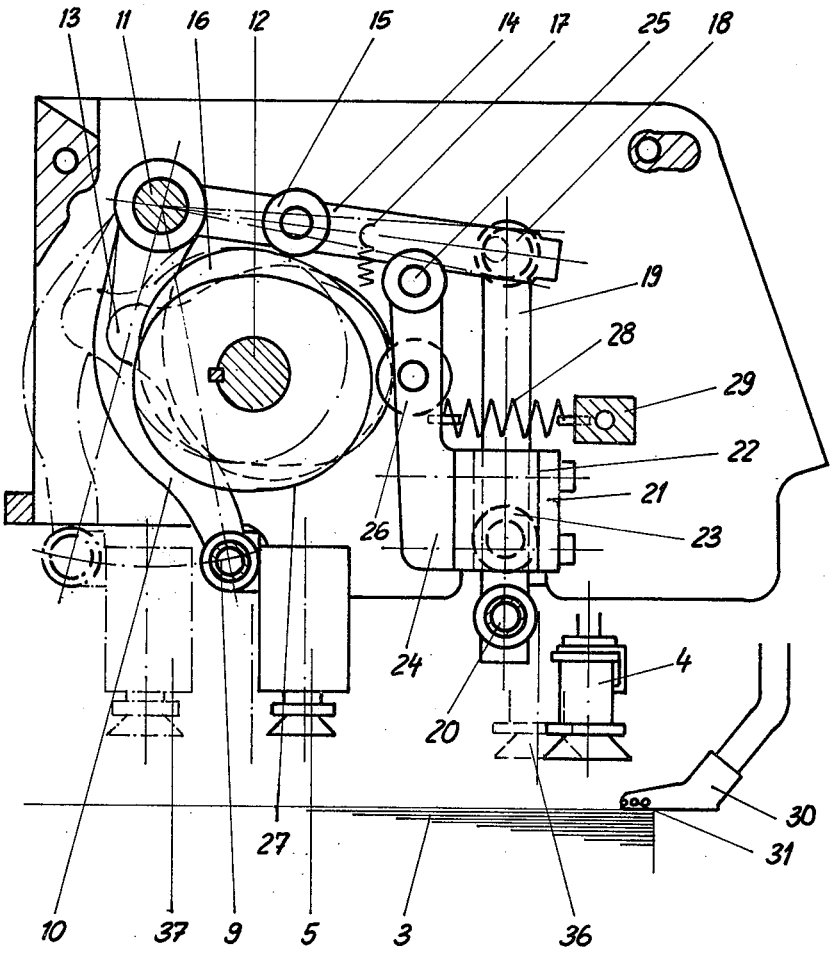
FIG. 3 is a longitudinal cross-sectional view taken through the suction head shown in FIGS. 1 and 2.
Figure 4:
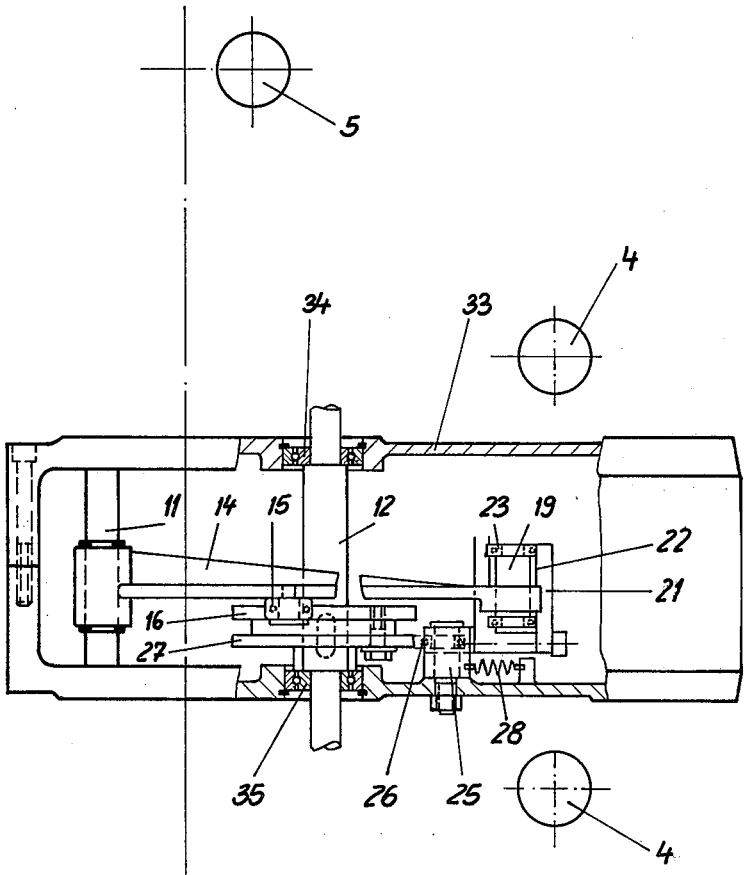
FIG. 4 is a top view of the same suction head shown in FIG. 3, partially in cross section but omitting the control means.

Referring to the drawings, FIGS. 1 and 2 show a suction head 1 for lifting the top sheet 2 off a pile of sheets 3. The suction head 1, which can be adjusted automatically to a given height carries two separation suction devices 4 which pass the lifted sheet 2 on to two transport suction devices 5. The transport suction devices 5 move the lifted sheet 2 into the gap between the transport cylinder 6 and the timing rollers 7. In this process the front edge of the transported sheet 2 must be moved over the stops 8.

As shown in FIG. 3, the transport suction devices 5 are attached to a mounting rod 9 which in turn is pivotally mounted to the free end of a crank lever 10. The crank lever 10 swings or pivots about a support shaft 11 which is fixed with respect to the suction head housing. The crank lever 10 is swung back and forth by a crank drive arranged on a control shaft 12. Accordingly, the transport suction devices 5 execute a reciprocating motion parallel to the surface of the pile 3, the parallel guidance of the former being provided by control means, not shown.

A roller lever 14 is pivotally mounted on the support shaft 11. The roller lever 14 rotatably mounts a roller 15 which engages and cooperates with a cam 16. The roller 15 is biased by a spring 17 against the cam 16. The cam 16 is attached or mounted on the control shaft 12.

An eccentric support 18 on which a free-swinging lever 19 is mounted, is provided at the free end of the roller lever 14. The eccentric support 18 is adjustable in such a manner that the height of the free-swinging lever 19 can be varied as desired. The lower end of the lever 19 carries a cross bar 20 to which the separation suction devices 4 are attached. The lever 19 is further brought or passes through a parallel guide 21 having guideways 22 by which the lever 19 is supported by means of two ball bearings 23. The parallel guide 21 is in turn suspended by means of a pendulum arm 24 pivotally supported from a bearing post 25. The pendulum arm 24 carries a roller 26 which cooperates with a cam 27 which is firmly keyed to the control shaft 12. A compression spring 28 is biased, on the one hand, against a rib 29 of the housing and, on the other hand, against the pendulum lever 24, whereby the roller 26 of the latter is biased against the cam 27.

A probing foot 30 is supported in the suction head 1 so that it can be lifted from the surface of the pile 3. The probing foot 30 has nozzles 31 on its front side through which air is blown under the lifted sheet 2.

The housing 33 of the suction head is designed in the shape of a shell. The control shaft 12 is supported rotatably therein by means of two ball bearings 34 and 35. The support shaft 11, on the other hand, is rigidly connected to the wall 33 of the housing.

The operation of the arrangement described above is as follows: In order to lift the top sheet 2 off of the automatically adjusted pile 3, the lever 19 is lowered by means of the control cam 16, the roller 15, and the roller lever 14 and in the process the movement of lever 19 is rectified and guided by the parallel guide 21. The separation suction devices 4 move accordingly down to the top sheet 2 of the pile of sheets 3. As the separation suction devices 4 come to the pile of sheets 3, underpressure is generated in the separation suction devices 4 and the top sheet 2 is thereby sucked up or drawn up onto the suction devices 4. This occurs after the probing foot 30 has been swung back. The cam 16 then causes the roller lever 14, the lever 19, and thereby the separation suction devices 4 to be lifted into the position which is shown by solid lines in FIGS. 1 and 3. The probing foot 30 then swings forward under the lifted sheet 2 and pushes or bears on the surface of the next-highest sheet of the pile 3. At the same time, support air is blown from the nozzles 31 of the support foot 30 and this separates the sheet 2 from the pile 3 all the way to the front edge, and thereby lifts the sheet 2.

As soon as the separation suction devices 4 reach the position shown by the solid lines in FIGS. 1 and 3, the crank mechanism 10–13 has also moved the transport suction devices 5 into the rear postion which is shown in solid lines in FIGS. 1 and 3. It should further be noted that the transport suction devices 5 are designed as dropping suction devices and therefore also drop onto the sheet 2 lifted up by the separation suction devices 4 when they are supplied with suction air. Thus the suction devices 5 begin taking over the sheet 2, that is, the suction devices 5 start sucking up the lifted sheet 2 as soon as the separation suction devices 4 have reached their highest position. The crank mechanism 10 to 13 then sets the transport suction devices 5 in motion in the transport direction, that is, in a direction which moves the sheet 2 from right to left as viewed in FIGS. 1 and 3, as the control shaft 12 continues to rotate.

At the same time the cam 27 controls the parallel guide 21 in the transport direction via the roller 26 and the pendulum lever 24 in cooperation with the compression spring 28, so that the separation suction devices 4 also move horizontally to the surface of the pile in the transport direction synchronously with the transport suction devices 5. This simultaneous movement of the two groups of suction devices 4 and 5 lasts or occurs until the separation suction devices 4 occupy the position 36 shown in broken lines in FIGS. 1 and 3. During the time that this distance is traversed the nozzles 31 blow support air continuously under the lifted and horizontally transported sheet 2. When the separation suction devices 4 have reached the position 36, shown in broken lines in FIGS. 1 and 3, the front edge of the sheet 2 has passed over the hinged stops 8, aided by the support air, so that the well-known "stumbling"

of the sheet when it enters the gap between the transport cylinder 6 and the timing rollers 7 can no longer occur.

After the separation suction devices 4 release the sheet 2, the transport suction devices 5 continue to transport the sheet until they reach the position 37 shown by broken lines in FIGS. 1 and 3. In this position, the lifted and transported sheet 2 can reliably be gripped by the transport cylinder 6 and the timing rollers 7. The separation suction devices 4 return during the further advance of the sheet 2 by the transport suction devices 5 to the position shown in solid lines due to the appropriate reciprocating return movement of the parallel guide 21 and thereafter are ready to begin with the lifting of the next sheet.

Due to the initial, synchronous motion of the separation suction devices 4 and the transport suction devices 5, a reliable and accurate transfer of the sheets between the two groups of suction devices 4 and 5 takes place, even if the transport suction devices, which are designed as dropping suction devices, exert suction unevenly in terms of time due to height differences of the sheet surface.

Because no additional suction devices are required to keep the sucked-up sheet up at its rear edge, any uncertainty regarding the suction is avoided. The crank mechanism 10 to 13 which has been tested at high speeds as regards its long life and favorable properties can be retained, according to the invention, in a manner which ensures reliable operation of the drive even under high stress. Furthermore, no transport travel is lost through drooping of the sheet transported by the transport suction devices because the nozzles can blast the underside of the transported sheet 2 relatively long. As mentioned heretofore, stumbling of the front edge of the sheet at the stops 8 cannot occur for this reason. However, it is important that the available travel distance can be utilized completely and in its entirety, which also has a beneficial effect on the running of the sheet.

The invention is, of course, not limited to the embodiment shown. Instead of swinging about the pendulum shaft 25, the parallel guide can, for example, also be actuated by a translatory motion.

The transport motion can furthermore be initiated by the drive of the transport suction devices or their mounting rod.

I claim:

1. A suction head for feeding sheets to further sheet transporting means comprising suction separation means for lifting sheets off a pile of sheets, transport suction means for taking over the sheet lifted by the suction separation means, said transport suction means being movable over a given transport distance for advancing the sheet in a transport direction towards said further sheet transporting means, and control means for moving said suction separation means in said transport direction over a distance shorter than said transport distance simultaneously with and at the same velocity as said transport suction means, whereby said separation suction means assist said transport means in transporting the lifted sheet over said shorter distance.

2. A suction head for feeding sheets according to claim 1 wherein said suction separation means including a suction device, a lever mechanism operatively connected to said suction device, and a first cam actuating said lever mechanism to provide vertical displacement of said suction device.

3. A suction head for feeding sheets to further sheet transporting means comprising suction separation means for lifting sheets off a pile of sheets, transport suction means for taking over the sheet lifted by the suction separation means and advancing said sheet in a transport direction towards said further sheet transporting means, and control means for moving said separation suction means in said transport direction for a predetermined part of the transport distance of said sheet at the same velocity as said transport suction means, whereby said separation suction means assists in transporting the lifted sheet over said part of said transport distance, said suction separation means including a suction device, a lever mechanism operatively connected to said suction device, and a first cam actuating said lever mechanism to provide vertical displacement of said suction device, said lever mechanism including a generally vertically disposed first lever on the lower end portion of which said suction device is mounted, guidance means guiding said lever as the latter moves in a vertical direction, means for pivotally and pendulously mounting said guidance means, and a second cam for effecting pivotal movement of said guidance means and the suction device mounted on said guided lever in a synchronous manner with the operation of said transport suction means.

4. A suction head for feeding sheets according to claim 3 wherein said lever mechanism includes a second lever, said first cam actuating said second lever, and an eccentric connection between said first and second levers to provide for adjusting the height of said suction device.

5. A suction head for feeding sheets according to claim 4 including a second shaft for pivotally mounting said second lever on a fixed pivotal axis.

6. A suction head for feeding sheets according to claim 5 wherein said transport suction means includes transport suction devices, and a third lever on which said transport suction devices are mounted, said third lever being pivotally mounted on said second shaft.

7. Apparatus as in claim 6 wherein said predetermined part of the transport distance is chosen so that the separating sucker can be in position to separate a subsequent sheet while the preceding sheet is still being forwarded by the transport sucker.

8. A suction head for feeding sheets according to claim 3 wherein said guidance means includes bearings for guiding said vertically disposed first lever, and a cam follower mounted on said guidance means for actuation by said second cam.

9. A suction head for feeding sheets according to claim 3 including a common first shaft on which said first and second cams are mounted.

10. A suction head for feeding sheets according to claim 3 including first biasing means biasing said lever mechanism against said first cam and second biasing means biasing said guidance means against said second cam.

* * * * *